United States Patent [19]

Van Ness

[11] 4,263,945

[45] Apr. 28, 1981

[54] AUTOMATIC FUEL DISPENSING CONTROL SYSTEM

[76] Inventor: Bradford O. Van Ness, 6511 East Lincoln Dr., Paradise Valley, Ariz. 85253

[21] Appl. No.: 50,477

[22] Filed: Jun. 20, 1979

[51] Int. Cl.[3] ..... B67D 5/01; B65B 3/26

[52] U.S. Cl. ..... 141/98; 137/234.6; 222/192; 235/61 R; 340/147 A

[58] Field of Search ..... 141/98, 231, 232, 233, 141/266, 269, 279, 284, 1, 192–229, 392; 222/192; 137/234.6; 235/61 R; 340/147 R, 147 A

[56] References Cited

U.S. PATENT DOCUMENTS

| | | | |
|---|---|---|---|
| 3,527,268 | 9/1970 | Ginsburgh | 141/98 |
| 3,536,109 | 10/1970 | Ginsburgh et al. | 141/98 |
| 3,629,858 | 12/1971 | Hayakawa et al. | 222/192 |
| 3,650,303 | 3/1972 | Chambers et al. | 141/98 |
| 3,688,085 | 8/1972 | Teter | 141/98 |
| 3,688,268 | 8/1972 | Bedjai et al. | 340/147 |
| 3,814,148 | 6/1974 | Wostl | 141/98 |
| 4,006,761 | 2/1977 | Bonafous | 141/98 |
| 4,034,193 | 7/1977 | Jackson | 222/192 |
| 4,072,929 | 2/1978 | Garmong | 340/147 |

*Primary Examiner*—Houston S. Bell, Jr.
*Attorney, Agent, or Firm*—Warren F. B. Lindsley

[57] ABSTRACT

A new and improved automatic fuel dispensing control system intended for use in serving a fleet of vehicles or equipment and requiring no operator action. A fueling receiver mounted in the fuel dispenser, a fueling transmitter mounted in each authorized vehicle, and a transmitter programmer comprise the system. Effective system security is afforded through the elimination of any requirement for keys, coded cards or the like.

11 Claims, 4 Drawing Figures

AUTOMATIC FUEL DISPENSING CONTROL SYSTEM

BACKGROUND OF THE INVENTION

Various types of business and governmental operations such as large construction companies and municipalities which utilize fleets of trucks, automobiles and machines of different types have a continuing need for automatically controlled fuel dispensing systems. Along with the fuel dispensing capability such systems should preferably incorporate a number of additional functions such as control of the type and maximum quantity of fuel supplied to a given vehicle, recording of the type and amount supplied along with the distance or hours-of-use reading of the vehicle, limitation of such services to approved vehicles, and, for reasons of safety, automatically preventing service if the vehicle is running.

Systems of this type may also be employed to serve a clientele consisting of a number of independent customers who have been approved to utilize the system. In such cases additional functions such as automatic credit checks and monthly billing might also be incorporated.

The users of such equipment are invariably interested in convenience and they share with the owner of the system a desire for fast service that will save time for the user and maximize the number of customers who can be served in a given period of time. For these reasons the system should preferably require no action or activating procedure on the part of the user.

The owner of the system also has a need for a system which is as secure as possible against illegal access. For this reason it is highly desirable that the user should not be required to carry a coded card or other activating device which is subject to loss, theft or duplication.

DESCRIPTION OF THE PRIOR ART

Various types of systems directed toward the realization of similar goals have been provided in the prior art, none of which fully meet the objectives of the present invention.

Hayakawa et al in U.S. Pat. No. 3,629,858 and Tetar in U.S. Pat. No. 3,688,085 disclose systems for automatically dispensing fuel with predetermined quantities and types of fuels, but in each case a coded card is employed by the user for the activation of the system.

Bonafous discloses in U.S. Pat. No. 4,006,761 a special valve and apparatus for use in the bottom loading of fuel tanks but it has little utility for other applications and provides virtually none of the automatic control and record keeping features sought in the present invention.

Bedjai et al in U.S. Pat. No. 3,688,268 disclose a system utilizing a cassette incorporating a transmitter and tape recorder carried by the user for activation of the system. The cassette is purchased by the user in a coded condition which gives the user access to the system for a given quantity of fuel. When the purchased amount of fuel has been consumed by the user, the spent cassette is returned and another coded cassette is purchased for continued use of the system.

Jackson and Garmong in U.S. Pat. Nos. 4,034,193 and 4,072,929, respectively, disclose systems using keyboard input devices to enable entry of data identifying authorized users and activating the fuel dispensers. Garmong further discloses computer controlled limitation of the quantity and type of fuel dispensed to a given user. In both cases the convenience of the system is severely limited by the requirement for a keyboard input device, and the security of the system is threatened by the possibility that knowledge of the code will fall into the wrong hands.

SUMMARY OF THE INVENTION

In accordance with the invention claimed, an improved automatic fuel dispensing control system is provided which conveniently controls access to the system, controls the amount and type of fuel dispensed and records and reports essential information to the owner of the system.

It is, therefore, one object of this invention to provide an improved automatic fuel dispensing control system.

Another object of this invention is to provide such a system in which the fuel dispensing equipment is activated to service only those vehicles which are authorized to use the system.

A further object of this invention is to provide such a system which may optionally limit access to the fueling site itself to authorized vehicles only.

A still further object of this invention is to provide such a system with a capability for controlling the type or grade of fuel which may be dispensed to a given vehicle.

A still further object of this invention is to provide such a system with a capability for limiting the quantity of fuel which may be dispensed to the maximum capacity of the fuel tank associated with a given vehicle.

A still further object of this invention is to provide such a system which incorporates adequate security means to prevent activation of the dispenser through the use of false data or counterfeit devices.

A still further object of this invention is to provide such a system with a capability for the monitoring and recording of the vehicle distance or hours-of-use reading.

A still further object of this invention is to provide such a system with a capability for preventing the dispensing of fuel under unsafe conditions as, for example, while the vehicle's engine is running.

A still further object of this invention is to provide such a system with a capability for totalizing and displaying the volume of fuel dispensed during each operation.

A still further object of this invention is to provide such a system with a capability to send a digital output message to an external recorder at the completion of each fueling operation containing all information necessary for the subsequent performance of fuel and vehicle usage analysis and/or billing operations.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
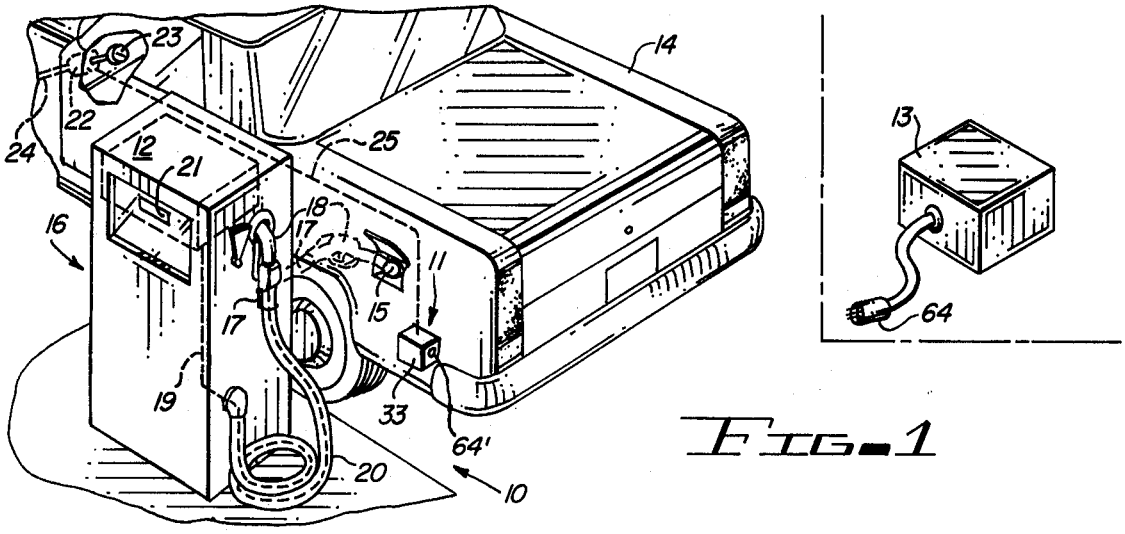
FIG. 1 is a diagrammatic representation of the fuel dispensing system of the invention with elements installed in the dispensing equipment and in a vehicle equipped to be fueled.
Figure 2:
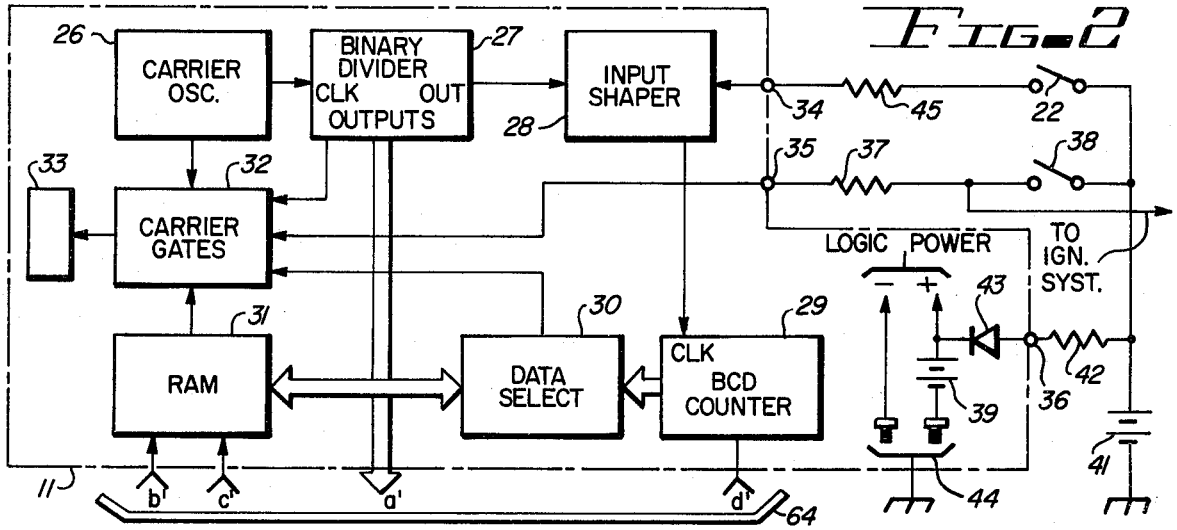
FIG. 2 is a block diagram of a fueling transmitter which comprises a first element of the system.

Referring more particularly to the drawing by characters of reference, FIG. 1 discloses an automatic fuel dispensing system 10 comprising a fueling transmitter 11, a fueling receiver 12, and a fueling transmitter programmer 13. A transmitter 11 is mounted on each vehicle 14 which has been qualified for service from the system 10. Preferably the mounting location is near the fuel entrance 15 of the vehicle 14. The receiver 12 is typically mounted inside the housing of the fuel dispensing unit 16 with electrical connection to a receiving antenna 17 mounted on or adjacent the nozzle 18 through which fuel is dispensed into entrance 15. The electrical connection is made by means of an electrical cable 19 attached to the fuel dispensing hose 20. One or more digital displays 21 of the gallons dispensed per operation may be incorporated into receiver 12. The transmitter programmer 13 is employed for the initial conditioning of each transmitter 11 for service with a particular vehicle 14. Between periods of use programmer 13 is stored by the owner or operator of the system 10.

Transmitter 11 is a small radio transmitter that operates at a long wavelength radio frequency to penetrate without appreciable attenuation all expected accumulations of ice, snow and dirt covering the device or its housing. The relatively low frequency also reduces directivity so that no critical orientation, other than distance, is required of the receiving device. The radiated power level is intentionally low so that the receiving range is restricted to a few feet from the unit. Interference is thus prevented with other receivers at the same fueling site and with other radio services. The low power requirements also permit continuous operation from the vehicle power source and the use of an internal back-up battery for long periods when the vehicle is not in use.

The transmitter output consists of a radio frequency signal modulated in a digital manner by a continuous, repeated message coded with the following data:

- A synchronization code to identify the start of each repeated message;
- A user control code to authorize the vehicle to draw fuel from the dispensers or sites operated by a specific user group;
- A vehicle identification code of sufficient character length to specify individually all vehicles authorized to be fueled from a site or sites operated by the same user group;
- A fuel type code to control the type or grade of fuel that may be dispensed to each specific vehicle tank or storage;
- A fuel quantity code to limit the maximum amount of dispensed fuel to the storage capacity of the vehicle or storage tank;
- A security check code to insure accurate reception of the above data prior to the activation of the fueling dispenser; and
- An accumulated distance or hours count code of sufficient characters to enable subsequent vehicle and fuel use calculations.

Except for the accumulated distance or hours count code, all of the foregoing data are programmed into an electronic memory incorporated within the transmitter unit at the time the transmitter is installed on a vehicle. No pre-selection of units or factory coding is required for any one user group. Different transmitter frequencies may be set at the factory to provide additional security between different user groups.

The programmable feature permits alteration of the coded data as necessary, for example, when a transmitter is transferred from one vehicle to another. Transmitter units are thus prevented from becoming obsolete when the host vehicle is removed from service.

The accumulated distance or hours count code is provided by means of an electronic counter incorporated in the transmitter unit. The counter may be activated by a pulser device 22 attached to the speedometer of tackometer 23, cable 24 and electrically connected to transmitter 11 by means of wires 25.

An optional feature is provided to inhibit transmission of data messages, and thus dispenser activation, if the ignition or other electrical control of the vehicle motive power or similar prime mover is in the "on" state. This prevents fuel from being dispensed under hazardous conditions.

The primary operating power for the transmitter unit is derived from the vehicle electrical system, but any direct or alternating current supply may be used at a voltage greater than six volts. The power required by the unit is sufficiently low that it may be connected directly to a vehicle battery at all times without causing an appreciable loss of charge over an extended interval during which the normal charging system is not in operation. This primary operating power is supplemented by an internal battery capable of maintaining the contents of the data memory and the distance/hours totalizer for a period of up to one week in the event of a failure or disconnection of the primary power source. The supplementary battery is activated only when the unit is physically mounted on a vehicle. The internal battery is thus prevented from discharging and the unit from unintentionally transmitting when in storage or in shipment prior to or between installations.

Each ungrounded lead to the transmitter unit is protected by current-limiting resistors at the point of cable termination to the vehicle electrical system so that insufficient energy is available to cause ignition of volatile, flammable fumes or liquids in the event of a short-circuit or other fault in the wiring.

The transmitter programmer unit 13 is employed to store the appropriate data in the transmitter memory at the time the transmitter is installed on a vehicle. Manually controlled switches are provided on the programmer to permit the setting of the vehicle identification code, the fuel type code and the fuel limit code. Additional switches or other means not readily accessible to the user are preset for entry of the user control code. Codes for synchronization and transmission security checks are automatically generated within the unit.

To program a unit the user follows prescribed routine. He first sets the vehicle identification code, the fuel type code and the fuel limit code on the accessible switches. He then connects the programmer to the transmitter and activates the programmer. When a visual indicator signals the completion of the coding cycle, the programmer is disconnected.

Under normal conditions, each transmitter is programmed only once for any one vehicle installation and the operation is performed by a responsible individual associated with the user group who has control of the security of the programmer unit.

Each fuel dispenser within the system is equipped with a fueling control receiver. Because the system is designed to transfer data at very low radiated power, the receiver antenna must be located in close proximity to the vehicle transmitter location at the time of fueling. For this reason the receiver antenna is normally installed close to or on the nozzle 18 as stated earlier. It is thus automatically positioned by the user as he inserts the nozzle 18 into the fuel entry port 15. No special effort is required on the part of the user for positioning or activation of the transmitter or receiver.

The receiver antenna is coupled to the receiver 12 by means of the cable 19 which may be a small coaxial cable fabricated as a part of the hose 20.

Electronic circuitry within the receiver performs the following operations: It amplifies the radio frequency signal from a fueling transmitter; it demodulates the signal to extract the encoded digital message; it controls the gain of the amplifier to maintain an undistorted signal level at varying distances between the receiving antenna and the vehicle transmitter; it incorporates a threshold device to squelch random noise and signals from other fueling transmitters in the vicinity; it separates the logic "0" and "1" levels from the demodulated signal for further processing; it detects the synchronization code to locate the starting point of each message; it stores the data contents of each message received; it checks the user control code against a pre-set or pre-stored matching value; it checks the fuel type code against a pre-set or pre-stored matching value; it calculates the security check code as each message is received for a matching value in the message; it rejects from storage and further processing all messages received having a correct synchronization code but any error in the user control code, the fuel type code, or the security check code, providing an "invalid" visual indication of this condition; it accepts and stores the vehicle identification data, the fuel type code, the fuel limit code and the odometer data when the first message is received that has a correct synchronization code, a correct user code, a correct fuel type code and a correct security check code and then activates a "valid" visual indication and a control output to the dispenser mechanism to permit the flow of fuel; it totalizes the quantity of fuel dispensed in common units such as gallons or liters, with an optional visual display of the current total for each fueling operation; it continues the "valid" condition so long as synchronization codes are being received from the vehicle transmitter; it terminates fuel flow if the fuel limit has been exceeded; it terminates the "valid" condition and the fuel flow control after a preset or pre-stored time delay following loss of correct synchronization codes when the fueling nozzle or coupling is withdrawn from the range of the transmitter; it generates and transmits an output message to an external recording device or data processor on a link common to all fueling control receivers at the same site or sites; and it inhibits reactivation of the receiver circuits until all output message data has cleared the receiver storage from a prior fueling operation to prevent overlap or alteration of data.

The output message from each fueling control receiver to the recording device contains the following coded elements as a serial digital bit stream: control codes to activate and/or deactivate the recording device and other data which may be inserted into the message at some other point; the vehicle identification data as received from the vehicle transmitter; the distance/hours reading as received from the vehicle transmitter; the fuel type code as received from the vehicle transmitter; the total fuel quantity dispensed during the fueling operation as totalized within the receiver unit; and, optional fill characters for the insertion of other data in the message, such as day and time information, at the recording device.

A modified form of the fueling receiver may be used with a longer-range receiving antenna to activate a gate mechanism or similar device to permit access to a specific fueling site or sites by only those vehicles which are correctly coded for that user group. The receiver will, in this case, be located near the gate mechanism with the antenna positioned to detect a vehicle at some suitable distance from the gate and the control output normally used to activate a dispenser activates the gate opening mechanism. In this case, the synchronization code, the vehicle identification code and the security check code are utilized for a "valid" condition permitting site access and an output message is generated to record those vehicles permitted to enter the site. The fuel type code, the fuel limit code and the distance/-hours readings are ignored.

The organization of the individual elements of the system including the transmitter 11, the transmitter programmer 13 and the receiver 12 is illustrated by the block diagrams 2, 3 and 4, respectively.

The fueling transmitter 11 comprises a carrier oscillator 26, a binary divider 27, an input shaper 28, a binary-coded decimal counter 29, a data selector 30, a random access memory 31, carrier gates 32 and an antenna plate 33.

The carrier oscillator 26 generates a stable radio frequency carrier for delivery to the carrier gates 32 and to the binary divider 27.

Divider 27 produces sub-harmonics of the carrier frequency. One of the lower frequencies thus generated is utilized by the carrier gates 32 for the generation of a self-clocking bit pattern of RF carrier for delivery to the internal antenna plate 33; another set of the generated lower frequencies is utilized for the sequencing of addresses to the memory 31, to the data selector 30 and to the external transmitter programmer 13 for the extraction of messages, one bit at a time.

The random access memory 31 contains the data inserted by the external programmer and furnishes this data, one bit at a time, to the carrier gates 32 in response to the sequential addresses. The stored data comprises the synchronization code, the user code, the vehicle identification code, the fuel type code, the fuel limit code and the security check code.

The input shaper receives signals from an external distance/hours pulser 22 supplied at terminal 34, removes contact bounce and other noise and delivers the processed signal to the counter 29.

Counter 29 cumulatively counts the distance/hours pulses in binary coded decimal code and delivers the instant sum to data selector 30.

Data selector 30 strobes the cumulative distance/-hours count into the carrier gates one bit at a time in response to the sequential addresses.

The carrier gates 32 receive data from the memory 31 and from the data selector 30 from which they generate an element within each bit period of the modulated carrier to impart the coded intelligence as an RF message dispatched from antenna 33. The gates 32 receive a logic level through terminal 35 and an external resistor 37 from the ignition switch 38 when the switch is closed. The logic level inhibits carrier output from gates 32 if switch 38 is in the ON state.

Antenna plate 33 is a metallic plate built into the transmitter housing. It radiates the modulated RF messages to the fueling receiver.

An internal battery 39 supplies power to the transmitter 11 if the vehicle power source 41 is below the required transmitter operating potential. It also acts as a voltage regulator and noise filter. The vehicle power source 41 normally supplies current to transmitter 11 through a current limiting resistor 42, terminal 36 and a diode 43, the cathode of which is connected to the positive terminal of internal battery 39. Diode 43 prevents battery 39 from discharging into other vehicle loads when source 41 is low or removed from the vehicle and rectifies the input current if the transmitter power source is alternating current.

A pair of mounting studs 44 make the power connection to transmitter 11 when transmitter 11 is installed. Connection of studs 44 to the vehicle frame effectively completes the connection of the transmitter 11 to both the internal battery 39 and to the vehicle source 41. They also furnish an RF return path to the vehicle chassis as a counterpoise to the antenna plate.

Current limiting resistors 45, 37 and 42 limit currents from the odometer pulser 22, ignition switch 38 and source 41, respectively. The current-limiting thus provided protects against the generation of sparks which might otherwise occur if the leads to terminals 39, 35 or 36 are accidentally shorted to the vehicle frame. Protection of this nature is essential for safety because of the volatile fuel vapors present.

Figure 3:
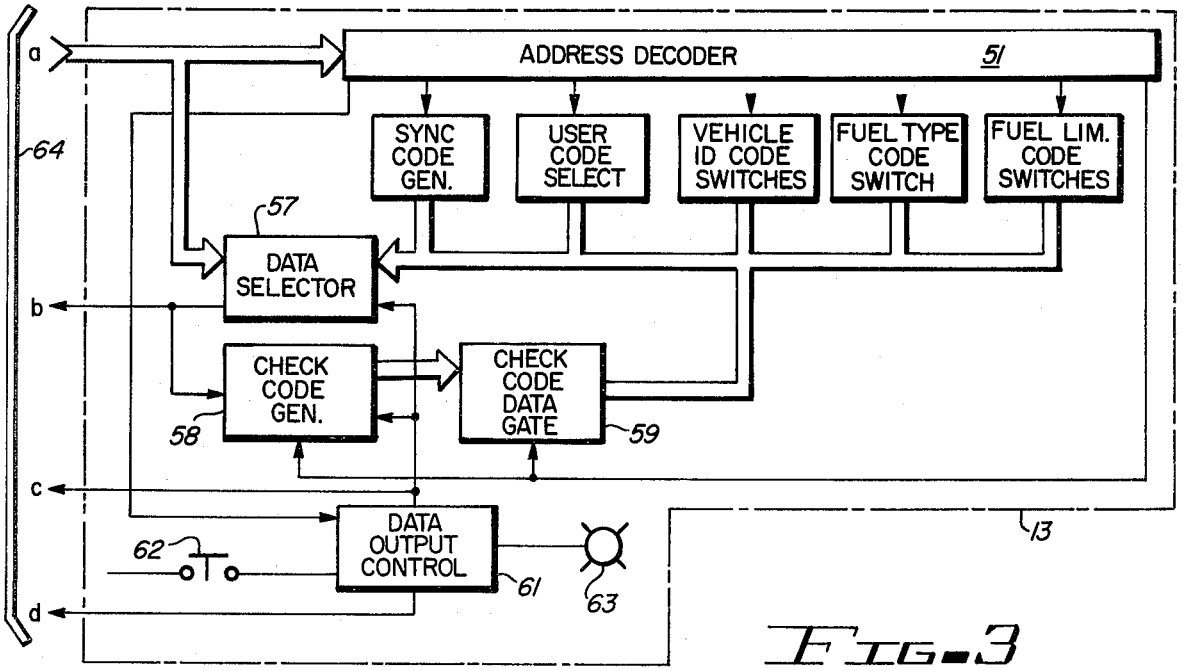
FIG. 3 is a block diagram of a fueling transmitter programmer comprising a second element of the system.

The fueling transmitter programmer 13 as shown in FIG. 3 comprises an address decoder 51, a sync code generator 52, a user code selector 53, vehicle ID code switches 54, a fuel type code switch 55, fuel limit code switches 56, a data selector 57, a check code generator 58, a check code data gate 59 and a data output control 61.

The address decoder 51 generates sequential outputs corresponding to the upper levels of binary addresses originating in a fueling transmitter binary divider 27. Signals from the decoder 51 are dispatched to the data output control 61, to sync code generator 52, user code selector 53, vehicle ID code switches 54, fuel type code switch 55, fuel limit code switches 56, fuel type code switch 55, fuel limit code switches 56, check code data gate 59, and check code generator 58. In response to these signals the following functions are implemented: a start signal is provided to the data output control 61; a message sync code is generated by the fixed-pattern sync code generator 52; a user code is generated by the semi-fixed pattern user code selector 53; a vehicle identification code is generated by means of operator accessible vehicle ID code switches 54; a fuel type code is generated by means of an operator accessible fuel type code switch 55; a fuel limit code is generated by means of operator accessible fuel limit code switches 56; and a signal is provided to the check code data gate 59 and to the check code generator 58, thereby connecting the generator 58 to the data selector 57 at the appropriate time in the message sequence and preventing the generator 58 from reacting to its own serialized input from the data selector 57 during this period. Coded thumbwheel switches may be employed for convenience as the coding switches 54, 55 and 56.

The data selector 57 sequentially scans the data bits formed by the sync code generator 52, the user code selector 53, the coding switches 54, 55 and 56, and the check code data gate 59 in response to lower-order address signals originating in the binary divider 27 of a fueling transmitter 11. A single serial-bit output is thus derived at each sequential step as a data input to the connected fueling transmitter memory.

The check code generator 58 responds to the serialized data output bits from selector 57 to produce a unique code which is employed in the fueling receiver 12 to verify that all other data bits in a message are correct.

The data output control 61 responds to the actuation of the RUN pushbutton 62 and the start signal from decoder 51 to initialize the check code generator 58 and to enable the output of the data selector 57 for one full binary sequence of transmitter address values. Control 61 also signals the operator to release the RUN pushbutton 62 at the end of the sequence by energizing an OPERATION COMPLETE indicator 63. During the programming sequence the control 61 generates and delivers a "write" signal to the memory 31 of the connected transmitter 11 to enter data from the programmer 13 into the memory 31 and providing a "reset" signal to the counter 29 of the transmitter 11 to clear the prior distance/hours reading.

Connections between the programmer 13 and the transmitter 11 are made by means of connectors 64 and 64', respectively, on the programmer and transmitter assemblies. Terminals a, b, c and d of connector 64 are connected, respectively, to terminals a', b', c' and d' of connector 64'. The connection at a and a' carries addresses from the transmitter 11 to the decoder 51 and data selector 57 of programmer 13, b-b' carries data from the data selector 57 to memory 31, c-c' carries the output signal for read/write control to memory 31, and d-d' carries the reset signal from data output control 61 counter 29.

Figure 4:
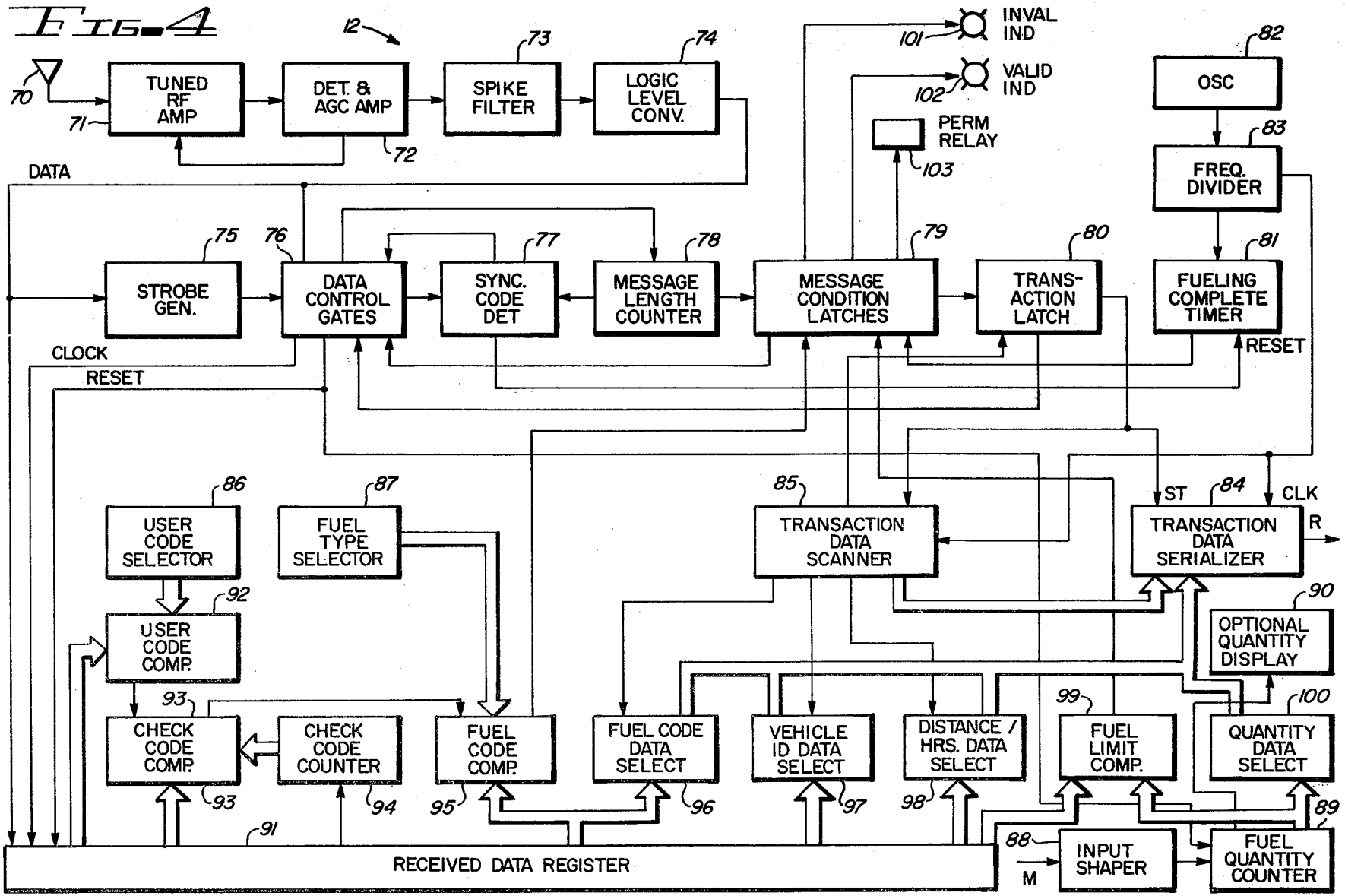
FIG. 4 is a block diagram of a fueling receiver comprising the third element of the system.

The fueling receiver 12 as shown in the block diagram of FIG. 4 comprises a receiving antenna 70, a tuned RF amplifier 71, detector and Automatic Gain Control Amplifier 72, a spike filter 73, a logic level converter 74, a strobe generator 75, data control gates 76, a sync code detector 77, a message length counter 78, message condition latches 79, a transaction latch 80, a fueling complete timer 81, an oscillator 82, a frequency divider 83, a transaction data serializer 84, a transaction data scanner 85, a user code selector 86, a fuel type selector 87, an input shaper 88, a fuel quantity counter 89, an optional quantity display 90, a receiver data register 91, a user code comparator 92, a check code comparator 93, a check code counter 94, a fuel code comparator 95, a fuel code selector 96, a vehicle ID data selector 97, distance/hours data selector 98, a fuel limit comparator 99, a quantity data selector 100, an INVALID indicator 101, a VALID indicator 102, and a permissive relay 103.

The signal from transmitter 11 received at antenna 70 is amplified by RF amplifier 71 and demodulated by amplifier 72 which provides automatic gain control as needed to compensate for variable signal strengths resulting from distances between the transmitter 11 mounted on the vehicle and the antenna 70 mounted near or on the hose nozzle 18. Impulse noise picked up by antenna 70 which may produce false digital signals is removed by spike filter 73.

The logic level converter 74 translates the filtered demodulated signals into full-voltage logic "ones" and "zeros" for processing by the other logic circuits. Converter 74 also incorporates threshhold discrimination to insure an adequate signal-to-noise ratio at antenna 70 before data can be processed further.

The strobe generator 75 creates a narrow pulse delayed from the leading edge of each bit period. The pulse is utilized to sample received logic "ones" and "zeros".

The data control gates 76 perform a number of functions: They control transfer of strobed data bits to sync code detector 77; limit the period over which strobe pulses are delivered to the message counter to the time between valid sync codes; limit the period during which clock pulses are delivered to the received data register 91 to the time between valid sync codes if the prior message is "invalid" and inhibit further register clocks once a "valid" message has been received until the data in the register has been cleared by an output transaction message; control the reset signal sent to the received data register 91 and to the fuel quantity counter 89, clearing these elements just ahead of new message data but not until a prior transaction message has been completed; and they inhibit reception of new data until a current transaction has been cleared from the receiver.

The sync code detector 77 responds to the received sync code from gates 76 at the start of each message by returning an output signal to the date control gates 76 when a correct sync code is present. It also maintains the fueling complete timer 81 in a reset state while correct sync codes are received.

The message length counter 78 counts the message bits from the end of a correct sync code to the last bit of each message and produces an output to reset the sync code detector 77 and to strobe the state of the code comparators into the message condition latches 79.

The received data register 91 stores the received data as a serial input clocked by the gated strobe pulses. All stored data appears as parallel bit outputs to the comparators and data selectors 92–99.

The user code comparator 92 compares the user code data bits contained in the received data register with the pattern in the user code selector 86 and delivers a "true" output to the check code comparator 93 if the codes match.

The check code counter 94 responds to the bit pattern passing through the received data register 91 as it is being loaded by an input message. Counter 94 duplicates the function of the check code generator 58 in the fueling transmitter programmer 13.

The check code comparator 93 compares the check code data bits contained in the received data register 91 with the pattern appearing at the outputs of the check code counter 94 and delivers a "true" output to the fuel code comparator 95 if the codes match, provided the input from the user code comparator is true.

The fuel code comparator 95 compares the fuel code data bits contained in the received data register 91 with the pattern in the fuel type selector 87 and delivers a "true" output to the message condition latches 79 if the codes match and provided the inputs from the check code comparator 93 and from the user code comparator 92 are both true.

The message condition latches 79 utilize the strobe pulse generated by the message length counter 78 to determine the states of the three code comparators 92, 95 and 99. If a comparator output is "false", an "invalid latch" 79 will be set energizing the invalid indicator 101. The "invalid latch" 79 is reset by a subsequent valid comparator output or by the fueling complete timer 81. If the comparator output is valid (true), the "valid latch" 79 will be set, providing a first output to the data control gates 76 to inhibit further clock signals to the received data register 91, a second output to the valid indicator 102, and a third output to the permissive relay 103 which enables the delivery of fuel.

The input shaper 88 conditions the ON/OFF signals from an external fuel flow meter pulser M to eliminate contact bounce and induced noise.

The fuel quantity counter 89 counts the ON/OFF input cycles from the external fuel flow meter pulser M to totalize the amount of fuel dispensed for each fueling operating. The counter 89 is reset at the start of a new fueling operation when the initial sync code is received.

The optional quantity display 90 displays the current value of the fuel quantity counter 89 in visual digits for use by a fueling operator.

The fuel limit comparator 99 compares the instantaneous value of the fuel quantity counter 89 with the fuel limit data contained in the received data register 91. If the count value exceeds the register value, the comparator 99 signals the message condition latches 79 to de-energize the valid indicator 102 and the permissive relay 103 without resetting the valid latch 79 and itself.

The fueling complete timer 81 senses the loss of sync codes when the receiving antenna 70 near or on hose nozzle 18 is withdrawn from the range of the fueling transmitter 11. Timer 81 provides a short delay to prevent a false output due to signal level fluctuations which cause intermittent loss of valid sync codes during a fueling operation. It also produces an output to reset the "invalid" and "valid" latches 79 at the end of the delay.

The transaction latch 80 is set by the trailing edge of the "valid latch" 79 at the completion of a fueling operation. A first output to the data control gates 76 inhibits data reception during the transaction output period to prevent "smearing" of data within the received data register 91 and a second output enables the transaction data serializer 84 and starts the transaction data scanner 85.

The transaction data scanner 85 is a multifunctional element. The following functions are included: It generates special character codes such as carriage return, line feed, fills, spaces, etc. for use by an output recorder to produce the correct format; it scans the fuel code data selector 96 to produce a transaction output character corresponding to the vehicle ID data selector 97 to produce transaction output characters corresponding to the vehicle identification codes contained in the data register 91; it scans the distance/hours data selector 98 to produce transaction output characters corresponding to the distance/hours value codes contained in the data register 91; it scans the quantity data selector 100 to produce transaction output characters corresponding to to totalized fuel quantity contained in the fuel quantity counter 90; and it generates an "end" or "complete" signal to reset the transaction latch 80 so that messages for a subsequent transaction may be received.

The transaction data serializer 84 serializes the parallel character data bits from the transaction data scanner 85 and from the data selectors 96, 97, 98 and 100 into machine-readable code, typically that defined as ASCII with "start" and "stop" bits added, for use by an external data recorder.

A complete and effective automatic fueling system is thus provided which requires no operator intervention or special effort beyond the usual insertion of the nozzle 18 into the fuel entry 15 and the actuation of the nozzle lever.

Although but a single embodiment of the invention has been illustrated and described, it will be apparent to those skilled in the art that various changes and modifications may be made therein without departing from the spirit of the invention or from the scope of the appended claims.

What is claimed is:

1. An automatic fuel control dispensing system for vehicles comprising:

a fuel control transmitter for mounting on a vehicle and operable on long wavelength at low power radio frequency, said transmitter comprising a transmitting antenna which radiates modulated RF signals to a fuel control receiver, a programmable means for storing multiple digital input data comprising a meassage, and means including a carrier oscillator for selectively transmitting signals comprising said message through said transmitting antenna to the fueling receiver, said message comprising vehicle identification and fuel requirement needs of the vehicle on which said transmitter is mounted, said signals of said transmitter being modulated in a digital manner in a continuously repeated message, a transmitter programmer for storing in said programmable means at least a part of said message comprising a vehicle identification code, a fuel type code, a fuel limit code and a user code, a fuel control receiver for mounting on a housing of a fuel dispensing mechanism, said receiver comprising an antenna for receiving signals comprising a message transmitted by said transmitter, a demodulator for extracting the encoded digital information in said message, means for storing the data content of the message received, means for checking the message against stored information and rejecting from storage all messages received having an incorrect user's code and providing a visual indication of this condition, means for activating a fuel dispenser mechanism, and means for sequentially activating a recording device which monitors the operation of the previously actuated fuel dispenser mechanism.

2. The automatic fuel dispensing system set forth in claim 1 wherein:

said antenna of said receiver is mounted on the fuel dispensing mechanism in close proximity to said transmitter mounted on the vehicel when the vehicle is positioned for receiving fuel.

3. The automatic fuel dispensing system set forth in claim 1 in further combination with:

a fuel dispensing mechanism comprising a fuel pump haivng a fuel hose and nozzle and said antenna of said receiver being mounted near said nozzle.

4. The automatic fuel dispensing system set forth in claim 1 wherein:

said message comprises a synchronization signal to identify the start of each repeated message, a user signal to authorize the vehicel to draw fuel from the fuel dispensing mechanism, a fuel signal to control the type of fuel that may be dispensed to that vehicle, a fuel quantity signal to limit the maximum amount of fuel to be dispensed, and a security signal to insure accurate reception of the above signals prior to activation by said receiver of the fuel dispensing mechanism.

5. The automatic fuel dispensing system set forth in claim 4 wherein:

said message further comprises signals to identify the distance traveled by the vehicle between fueling stops.

6. The automatic fuel dispensing system set forth in claim 5 wherein:

said transmitter comprises an electron counter activated by a pulser attached to the speedometer drive of the associated vehicle.

7. The automatic fuel dispensing system set forth in claim 1 wherein:

said transmitter comprises a means for inhibiting its transmission of said message if the electrical controls for energizing the operation of the associated vehicle is in the "on" state.

8. The automatic fuel dispensing system set forth in claim 1 in further combination with:

means for connecting said transmitter to the electrical system of the associated vehicle for energization thereof.

9. The automatic fuel dispensing system set forth in claim 1 in further combination with:

battery means within said transmitter capable of maintaining said message in a memory of said transmitter for a period of time of the electrical system of the associated vehicle fails.

10. The automatic fuel dispensing system set forth in claim 1 wherein:

said receiver further comprises means for deactivating the associated recording device after it has received data transmitted to it by said receiver.

11. The automatic fuel dispensing system set forth in claim 1 in further combination with:

a recording device for receiving data transmitted by said receiver for accummulating and printing out data from said receiver for each vehicle serviced by said receiver.

* * * * *

UNITED STATES PATENT OFFICE

CERTIFICATE OF CORRECTION

Patent No. 4,263,945 Dated April 28, 1981

Inventor(s) Bradford O. Van Ness

It is certified that error appears in the above-identified patent and that said Letters Patent are hereby corrected as shown below:

Claim 2, line 5, cancel "vehicel" and substitute ---vehicle---.

Claim 3, line 4, cancel "haivng" and substitute ---having---.

Claim 4, line 5, cancel "vehicel" and substitute ---vehicle---.

Claim 6, line 3, cancel "electron" and substitute ---electronic---.

Claim 9, line 5, cancel "of" second occurence, and substitute ---if---.

Signed and Sealed this

*Twenty-first* Day of *July 1981*

[SEAL]

*Attest:*

GERALD J. MOSSINGHOFF

*Attesting Officer*

*Commissioner of Patents and Trademarks*